US010145118B2

(12) United States Patent
Veys et al.

(10) Patent No.: US 10,145,118 B2
(45) Date of Patent: Dec. 4, 2018

(54) SCREEN DEVICE

(71) Applicant: RENSON SUNPROTECTION-SCREENS NV, Waregem (BE)

(72) Inventors: Thierry Veys, Deinze (BE); Michael Tokmaji, Waregem (BE); Kristof Lemiegre, Ghent (BE); Pieter Brabant, Oostnieuwkerke (BE); Frederik Van Luchene, Zulte (BE); Koen Verfaillie, Rumbeke (BE); Patrick Perquy, Drongen (BE); Bart Pieter Jules Abeel, Sint-eloois-winkel (BE)

(73) Assignee: RENSON SUNPROTECTION-SCREENS NV, Waregem (BE)

( * ) Notice: Subject to any disclaimer, the term of this patent is extended or adjusted under 35 U.S.C. 154(b) by 0 days.

(21) Appl. No.: 15/110,721

(22) PCT Filed: Jan. 9, 2015

(86) PCT No.: PCT/IB2015/050159
§ 371 (c)(1),
(2) Date: Jul. 8, 2016

(87) PCT Pub. No.: WO2015/104675
PCT Pub. Date: Jul. 16, 2015

(65) Prior Publication Data

US 2016/0333587 A1 Nov. 17, 2016

(30) Foreign Application Priority Data

Jan. 10, 2014 (BE) ..... 2014/0015

(51) Int. Cl.
*E04B 1/18* (2006.01)
*E04D 13/064* (2006.01)
(Continued)

(52) U.S. Cl.
CPC ..... *E04D 13/064* (2013.01); *E04F 10/00* (2013.01); *E04F 10/0685* (2013.01);
(Continued)

(58) Field of Classification Search
CPC ..... E04D 13/064; E04D 2013/0893; E04F 10/0685; E04F 10/00; E04H 6/025;
(Continued)

(56) References Cited

U.S. PATENT DOCUMENTS 1,719,303 A * 7/1929 Nelson ..... E04F 10/0603 160/22
3,332,179 A 7/1967 Toti

FOREIGN PATENT DOCUMENTS

BE 1019571 A5 8/2012
DE 1784021 A1 7/1971
(Continued)

OTHER PUBLICATIONS

International Search Report dated Jun. 2, 2015.

*Primary Examiner* — Patrick J Maestri
(74) *Attorney, Agent, or Firm* — Symbus Law Group, LLC; Clifford D. Hyra

(57) ABSTRACT

A screen device (I), comprising a covering which comprises a beam (2, 3, 4) as a structural part (2, 3, 4) of the covering and which is attachable to at least one adjacent structural part (2, 3, 4, 5) of the screen device (I), and comprises a end cap (6, 6') which is attachable to one end of the beam (2, 3, 4) in order to attach the beam (2, 3, 4) to the adjacent structural part (2, 3, 4, 5) of the screen device (I).

20 Claims, 8 Drawing Sheets

(51) Int. Cl.

| | |
|---|---|
| ***E04H 6/02*** | (2006.01) |
| ***E04F 10/00*** | (2006.01) |
| ***E04F 10/06*** | (2006.01) |
| *E04D 13/08* | (2006.01) |
| *E04B 1/00* | (2006.01) |
| *E04B 1/24* | (2006.01) |
| *E04C 3/04* | (2006.01) |

(52) U.S. Cl.
CPC ..... *E04H 6/025* (2013.01); *E04B 1/0046* (2013.01); *E04B 2001/2409* (2013.01); *E04B 2001/2451* (2013.01); *E04C 2003/046* (2013.01); *E04C 2003/0417* (2013.01); *E04C 2003/0439* (2013.01); *E04D 2013/0893* (2013.01)

(58) Field of Classification Search
CPC ..... E04C 2003/0417; E04C 2003/0439; E04C 2003/046; E04B 2001/2409; E04B 1/0046; E04B 2001/2451
See application file for complete search history.

(56) References Cited

FOREIGN PATENT DOCUMENTS

| | | | |
|---|---|---|---|
| EP | 2204515 | A1 | 7/2010 |
| EP | 2333194 | A2 | 6/2011 |
| EP | 2351896 | A2 | 8/2011 |
| EP | 2578767 | A1 | 4/2013 |
| FR | 1329656 | A | 6/1963 |
| NL | 1031656 | C2 | 10/2007 |

* cited by examiner

SCREEN DEVICE

This application claims the benefit of Belgian Patent Application No. BE-2014/0015, filed Jan. 10, 2014, which is hereby incorporated by reference in its entirety.

FIELD OF THE INVENTION

The present invention relates to a screen device, comprising a covering which comprises a beam as a structural part of the covering and which is attachable to at least one adjacent structural part of the screen device.

BACKGROUND

Such screen devices are usually installed to screen off an outside space or, on the contrary, to open it up. Thus, such screen devices are often installed in domestic dwellings, restaurants, shops and the like to protect an outdoor terrace or the like from the sun, precipitation and/or wind or, on the contrary, to allow the sunlight through temporarily. These screen devices may be designed in the form of awnings, pergolas, verandas, terrace coverings, carports, etc.

Such a screen construction typically comprises a roof construction (covering) which is at least partly supported by columns. The covering usually comprises several beams as structural parts which are assembled to form one or more frames. Such a frame is typically supported on four (or more) columns or is, also typically, attached to a wall on one or more sides for support and supported on another side by two (or more) columns. The columns are structural parts of the screen device (in addition to the beams). The covering may be fixed or may comprise a screen which can be rolled up and unrolled, or may comprise optionally rotatable and/or slidable slats, etc. Such screen devices are often also provided with electrical components, such as lighting and/or heating. Furthermore, these screen devices are also often provided laterally with screens to screen off the opening between two columns. In this case, this opening may be screened off by a screen which can be rolled up onto and unrolled from a screen roller. It is also possible to provide sliding walls therein.

In such screen devices, a roof construction usually comprises several beams which are often assembled to form a frame. These beams are typically fastened on top of or between the columns.

Constructing a screen device in situ is often laborious in practice. When such a beam is for example provided with a screen roller with a cloth which can be rolled up onto and unrolled from the screen roller to form a wall-forming element of the screen device, then such a beam is relatively heavy.

When the dimensions of such screen devices have to be modified in order to adapt the screen device, for example, to environmental factors, then not only do the beams and/or the columns have to be sawn to length, but in many cases they also have to be milled to suitable shapes in order to make it possible to attach, for example, gutters or screen guides or fittings, etc.

Until now, it was necessary to provide a relatively large number of standard parts or to carry out a relatively large amount of made-to-measure modifications per variant in order to make it possible to vary the construction of screen devices while still keeping installation relatively simple.

In a screen device as described in EP 1 493 884 A2, parts of the lateral beams project with respect to the columns after the lateral beams have been fastened on top of the columns.

This is often undesirable in cases where a screen device is to be added onto an existing building, in which case the columns will be located in undesired positions. Also from an aesthetic point of view, screen devices in which the beams (and thus the covering) do not project beyond the columns are usually preferred. However, the lateral beams of this screen device are adapted to make it possible to erect several screen devices next to one another in an easy manner.

With this screen device, the cross beams are provided between the lateral beams. These cross beams either have to be fitted between the lateral beams before these are installed on the columns or have to be fitted between the lateral beams after these have been installed on the columns. In the first case, it has to be possible to fit a relatively heavy frame on top of the columns. In the second case, this cross beam first has to be lifted up in the correct position between the lateral beams before it can be secured. Lifting a heavy beam is not easy and in both cases, installing such a beam is therefore a relatively laborious task.

In a screen device as described in EP 2 011 932 A1, lateral beams are connected to the columns at an angle and a front beam is fitted between the columns. In order to modify the dimensions of such a screen device, the front beam may be sawn to size at one of its two ends. Analogously, the lateral beams and the columns may be shortened at their end facing away from the end which is to be connected to a corresponding column or lateral beam at an angle. However, in order to fit such a front beam between two columns, it first has to be lifted up into the correct position before it can be fastened. Lifting such a heavy beam is not easy in this case either, making the installation of such a front beam in situ a relatively laborious task.

With regard to arrangement, this screen device offers little flexibility, since it always has to be fitted in such a manner that it adjoins a wall and can therefore not be erected in a detached position. However, it is possible to erect several screen devices next to one another in a simple manner, but not behind one another.

A screen device as described in BE 1 019 767 A3 allows a greater degree of flexibility in the construction of the screen device, since such screen devices can be arranged both next to each other and behind each other and can also be erected in a detached position as well as attached to existing buildings. Depending on the positioning, modified beams and columns are required to this end plus modified connecting pieces and/or milling in order to provide for the required drainage.

With regard to construction, the beams of this screen device are fitted between the columns, so that it is likewise necessary here to firstly lift the beams up into the correct position before they can be fastened.

SUMMARY

It is the object of the present invention to provide a screen device according to the present invention which can be arranged in more configurations using fewer standard parts and requiring fewer made-to-measure modifications than has hitherto been possible with the prior-art screen devices and which still allows simple installation of the screen device.

This object of the invention is achieved by providing a screen device, comprising a covering which comprises a beam as a structural part of the covering and which is attachable to at least one structural part of the screen device, wherein said screen device comprises a end cap which is attachable to an end of the beam in order to attach the beam to the adjacent structural part of the screen device.

In order to modify the dimensions of the screen device, it is possible to saw said beam to size and achieve the connection to an adjacent structural part by means of the end cap, in which case milling or other made-to-measure modifications are greatly reduced. This greatly simplifies the installation of such a screen device. This also allows for a greater variation in the possible arrangements of such a screen device. Preferably, all structural parts of the screen device are thus connected to each other by means of end caps.

Using a limited number of standard finishing elements, it is possible to close the space between the beam and the adjacent structural part.

In a particularly advantageous embodiment of a screen device according to the present invention, the beam is hollow, the beam comprises an internal gutter in its cavity for draining off the precipitation falling onto the covering and the end cap is provided with a passage opening for connecting to the internal gutter so as to enable precipitation drained off via the internal gutter to flow into a cavity of the adjacent structural part.

Centrally draining off the precipitation in this way not only allows the required ducts for drainage to be incorporated into this beam in a pleasing manner, but also further increases the flexibility of the construction of the screen device using a limited number of standard parts and without many additional made-to-measure modifications. In the prior art, where precipitation was taken into the columns, for example from lateral gutters of beams, additional connecting pieces often had to be provided in order to be able to take the precipitation from the lateral gutter as far as inside the column. In order to be able to drain off precipitation from adjacent screen devices for example into the same column, other connections at the location of the column were often required than is the case when only precipitation from one lateral gutter had to be drained off into this column. Due to the fact that the precipitation is now already taken into the core of this beam at the location of this beam, precipitation can flow into the cavity of the adjacent structural part via the end cap by means of which this beam is connected to an adjacent structural part. In this way, it is possible to integrate bringing the precipitation inside with the design of the beams and no additional connecting pieces have to be provided to this end or fewer if any made-to-measure modifications have to be carried out in situ during construction of the screen device.

The beam of such an embodiment comprising an internal gutter in the beam is preferably provided with a lateral gutter for collecting precipitation falling onto the covering and which extends at least partly next to the internal gutter, in which case a partition extends between the lateral gutter and the internal gutter and is provided with perforations for draining off, through the latter, precipitation from the lateral gutter towards the internal gutter.

Such a lateral gutter is typically present in screen devices in which the covering is provided with movable parts which temporarily close off or open the covering, such as a screen which can be rolled up and unrolled or rotatable and/or slidable slats, etc. In this case, this lateral gutter has to extend underneath the lateral ends of the movable parts in order to be able to drain off precipitation falling onto these movable parts towards this lateral gutter. According to this embodiment according to the present invention, precipitation which falls onto this lateral gutter is now drained off through the perforations in the partition, via the internal gutter in the beam.

The partition is preferably provided with perforations of such dimensions that this partition can also advantageously serve to catch leaves.

The lateral gutter and the internal gutter of such an embodiment preferably form part of the same gutter profile. In this way, the transition between the lateral gutter and the internal gutter is guaranteed to be watertight.

With a particularly advantageous embodiment of a screen device according to the present invention comprising an internal gutter in the beam, the end cap comprises a spout-shaped piece adjoining the passage opening and the screen device comprises a collector which is arrangeable between the beam and the adjacent structural part in order to allow precipitation to flow into the collector via the spout-shaped piece and through the passage opening towards the cavity of the adjacent structural part. It is thus possible to supply the precipitation in a more targeted way. This is particularly advantageous if this precipitation is to be allowed to flow in certain parts of the adjacent structural part, but not in other parts thereof, such as for example parts in which parts having a different functionality, such as for example screen guides or lighting or heating or drive elements, etc. are fitted.

The collector is preferably configured as a collecting recess which comprises at least one insertion space at its top edge, in which the spout-shaped piece is arrangeable on the top edge of the collecting recess. By means of such a positioning of the spout-shaped piece with respect to the collector, it is possible to ensure watertightness at the location of the connection between the spout-shaped piece and the collector in an advantageous way.

In an advantageous embodiment, the collector comprises several insertion spaces in order to fit the spout-shaped piece into the corresponding insertion space.

The beam of a specific embodiment of a screen device according to the present invention comprises an internal cavity, in which a screen roller of the screen device is arrangeable.

After the end cap has been fitted to the end of the beam, preferably at least one through-opening extends next to the end cap in such an embodiment, through which through-opening a screen which can be rolled up onto and unrolled from the screen roller may partly extend.

In this case, the end cap furthermore preferably comprises a central part which extends at a certain distance from the beam after the end cap has been fitted to the end of the beam and to which the screen roller is coupleable to accommodate the screen roller in the internal cavity.

More specifically, the central part may to this end comprise coupling elements in the direction towards the beam for coupling coupling elements of the screen roller thereto in order to accommodate the screen roller in the internal cavity.

A particular embodiment of a screen device according to the present invention comprises a column as an adjacent structural part for supporting the beam for supporting the covering. With such an embodiment, the end cap preferably comprises a base body for attaching the end cap to the end of the beam and an attachment member which extends with respect to the base body and which is arrangeable at the top of the column in such a way that the beam extends substantially above and next to the column in order to couple the beam to the column to support the beam.

By means of the end cap, it is thus possible to allow the beam to rest on the column before it is fitted to the column.

Therefore, the beam does not have to be lifted up in order to be able to fit it to the column.

Due to the fact that the beam extends substantially above and next to the column and in a known location, a limited number of standard finishing elements can be provided to close off the space above the column and next to one or more beams adjacent to the latter. Due to the end cap, it is possible to attach a beam which thus extends substantially above and next to the column still sufficiently securely to the column to be able to realise the required transmissions of forces.

Preferably, in such an embodiment, the attachment member is configured as a pin which extends downwards with respect to the base body and is arrangeable in the top of the column. By using a pin which is arrangeable in the top of the column, the beam can also be correctly positioned with respect to the column in a simple way before attaching it and without having to lift the beam.

In such an embodiment comprising a column and a pin, the column is preferably hollow and the pin is arrangeable in the cavity of the column in such a way that the pin engages behind a side wall of the column.

In a particular embodiment of a screen device according to the present invention comprising a collector with a spout-shaped piece and column, said collector can be fitted on top of the column in order to allow precipitation to flow into the collector via the spout-shaped piece and through the passage opening to the column. If the column is hollow in this case, then the screen device preferably comprises a drainpipe which is arrangeable in the cavity of the column in order to drain off precipitation via the column and the collector preferably comprises a connecting piece in order to connect the collector to this drainpipe.

In an advantageous embodiment of a screen device according to the present invention, the beam comprises a core profile to which one or more cover profiles are attachable. In this way, the beam can be constructed in such a way that the internal spaces of the beam remain accessible at all times. In this case, the core profile preferably provides the required strength and stiffness of the beam. The cover profiles serve for protection. In this way, it is not only possible to provide the beam with an aesthetic finish, but it is also possible, for example, to incorporate parts, such as electrical components, into the beam, in which case protection of these parts against external influences is ensured.

Preferably, the beam of such an embodiment in this case comprises several profiles which have been riveted together to form the core profile of the beam. In this way, the beam can be provided with more functionalities than a beam whose core profile consists of a single part. By riveting the different profiles together, it is possible to ensure that they function as a whole in order to absorb loads and provide the required strength and stiffness of the beam.

If the internal gutter and the lateral gutter of such an embodiment form part of the same gutter profile, this gutter profile preferably also forms part of the core profile.

The covering of a screen device according to the present invention may furthermore comprise a second beam as second structural part and a second end cap which is attachable to an end of the second beam. The screen device then preferably comprises a reinforcing coupling piece for coupling said end caps to each other. With such a coupling piece, it is easy to fit the beams in the correct position with respect to each other and subsequently to align further parts, such as for example finishing profiles, in the correct position.

BRIEF DESCRIPTION OF THE DRAWINGS

The present invention will now be explained in more detail with reference to the following detailed description of some advantageous embodiments of a screen device according to the present invention. The sole aim of this description is to give illustrative examples and to indicate further advantages and features of the present invention and can therefore not be interpreted as a limitation of the area of application of the invention or of the patent rights defined in the claims.

Reference numerals are used in this detailed description to refer to the attached drawings, in which.

DETAILED DESCRIPTION

Figure 8:
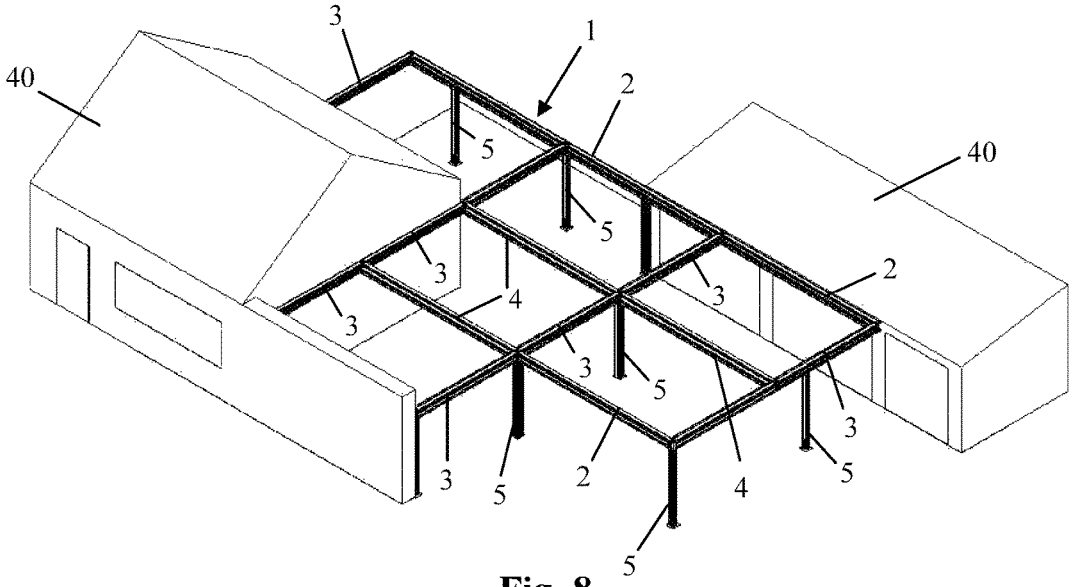
FIG. 8 shows a perspective view of the support structure of a screen device according to the present invention.

The screen device (1) illustrated in FIG. 8 comprises several beams (2, 3, 4) as structural parts which have been assembled to form frames which, on one side, are attached to existing buildings (40) and, on the other side, are supported by several columns (5) as structural parts of the screen device (1). This illustrated screen device (1) shows the large degree of flexibility of a screen device (1) which can be arranged in different configurations using a limited number of standard parts which are shown in more detail in the other figures.

Figure 2:
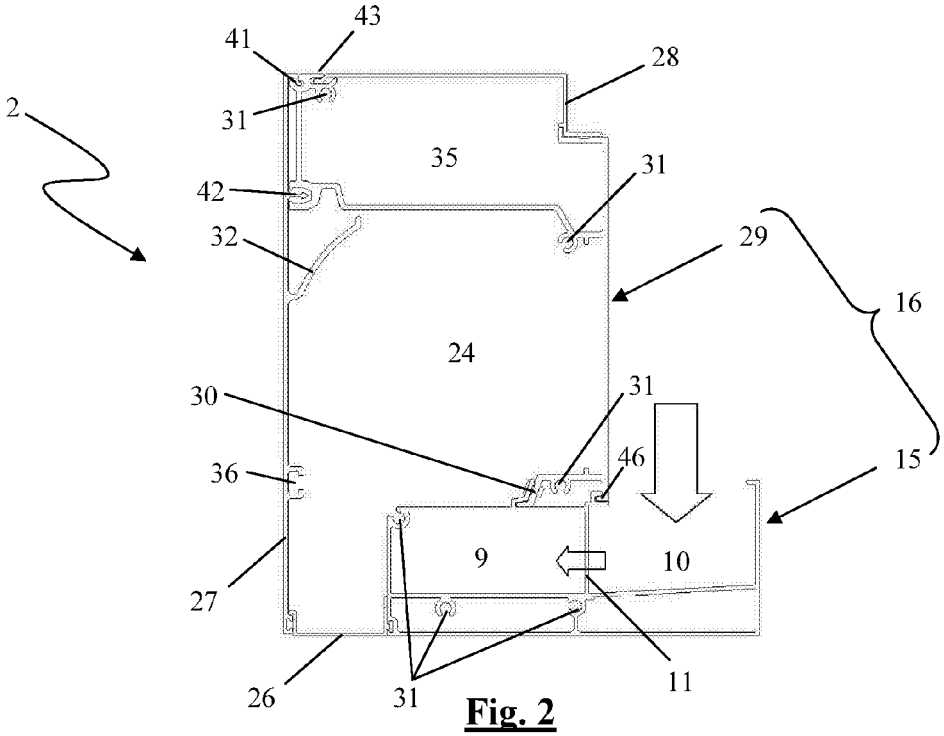
FIG. 2 shows a cross section of a first beam of a screen device according to the present invention.
Figure 3:
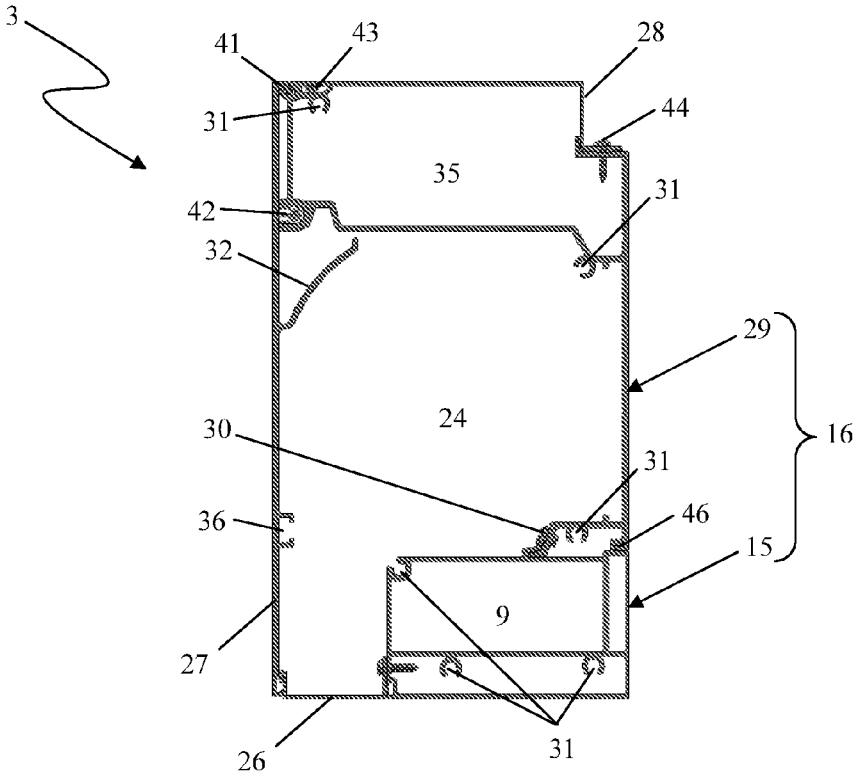
FIG. 3 shows a cross section of a second beam of a screen device according to the present invention.
Figure 4:
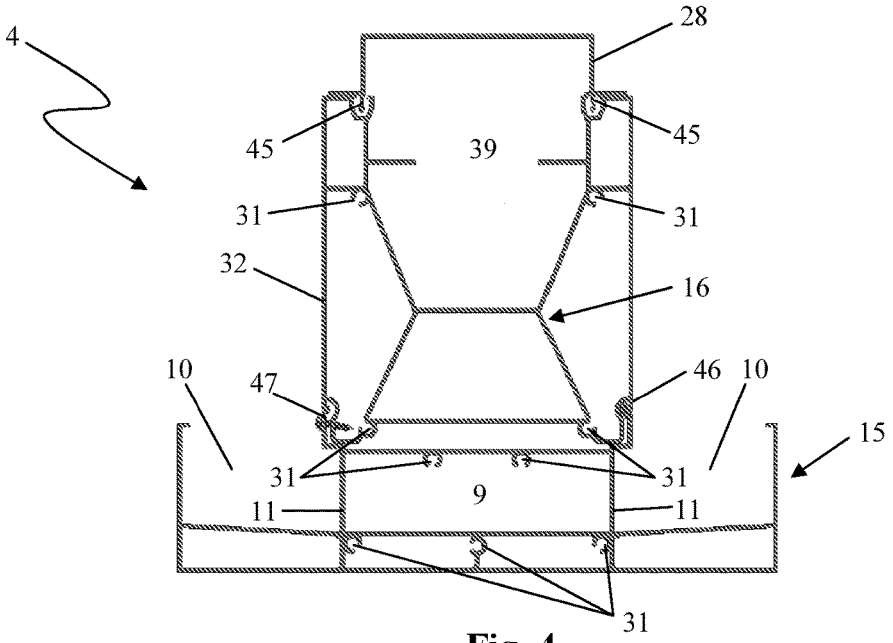
FIG. 4 shows a cross section of a third beam of a screen device according to the present invention.

This screen device (1) only comprises three types of beams (2, 3, 4), which are:

- a beam (3) which serves as a clamping beam and is illustrated in FIG. 3 in cross section;
- a beam (2) which serves as a pivot beam on an outer side of the screen device (1) and is illustrated in FIG. 2 in cross section; and
- a beam (4) which serves as a pivot beam in the centre of the screen device (1) and is illustrated in cross section in FIG. 4.

Figure 1:
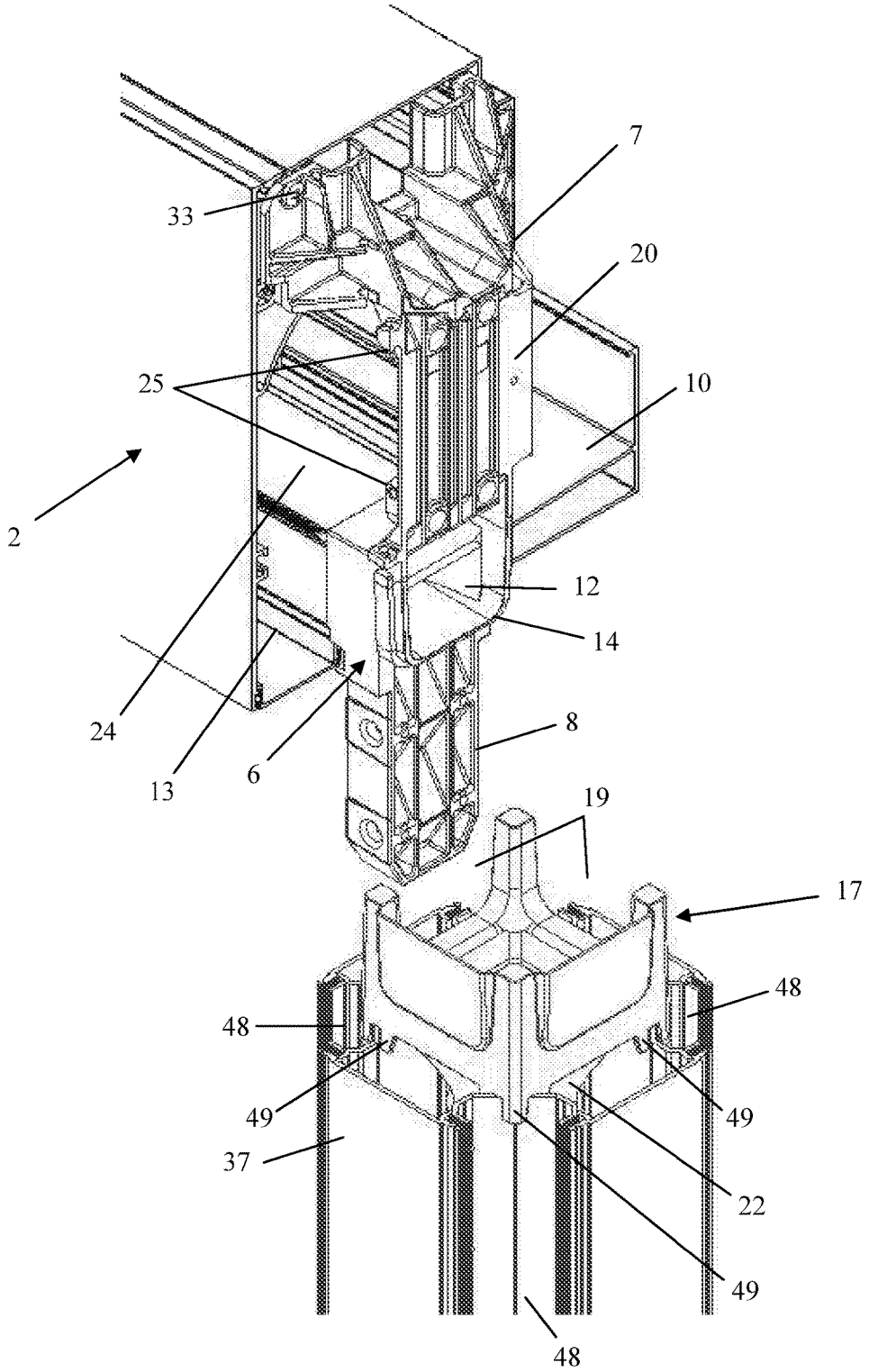
FIG. 1 shows a perspective view of the way in which a beam of a screen device according to the present invention can be attached to a column of this screen device.
Figure 6:
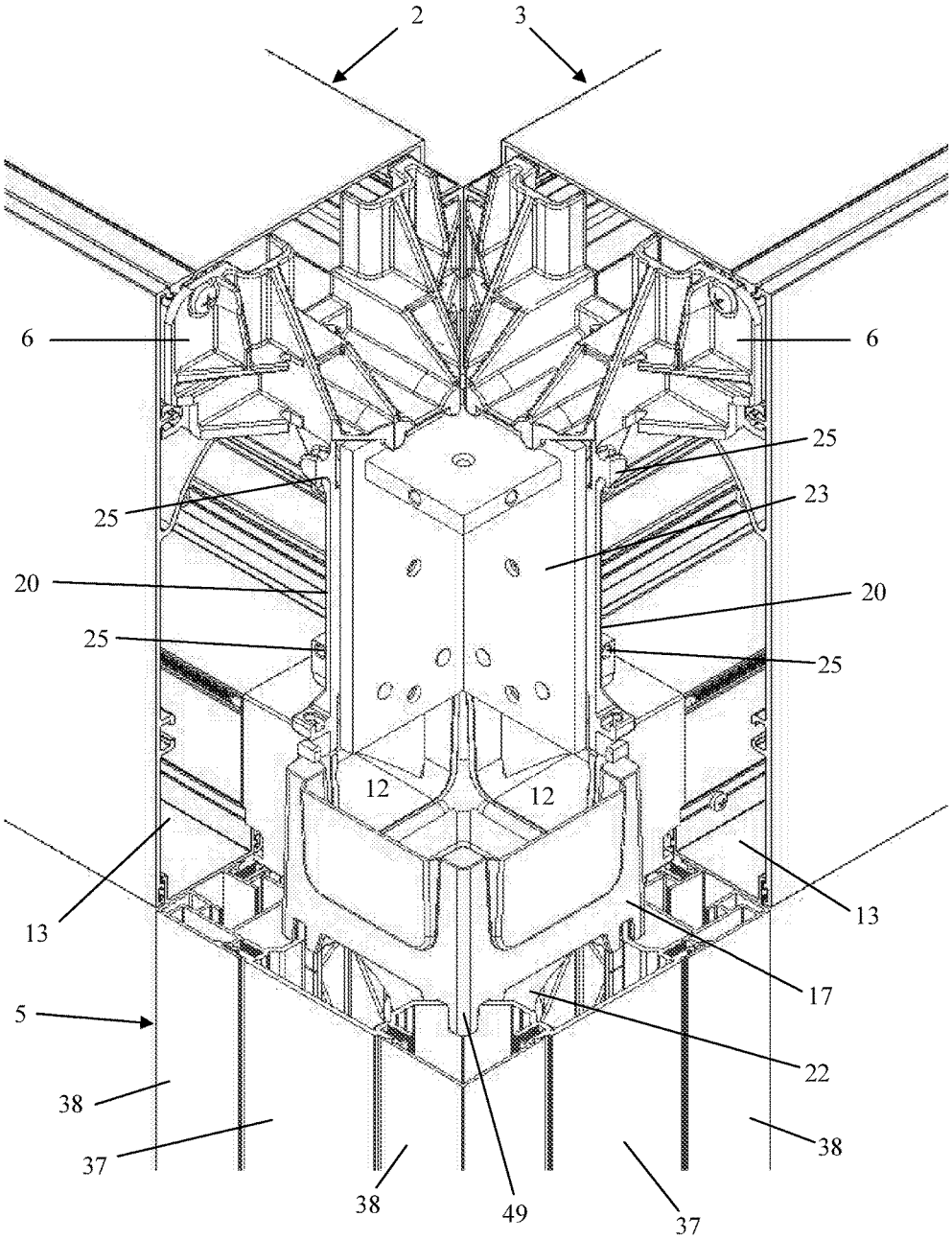
FIG. 6 shows a perspective view of the way in which two beams of a screen device according to the present invention are coupled to each other at an angle and fitted to the top of a column of this screen device.

In addition, this screen device (1) only comprises one type of column (5) which is shown in more detail in FIG. 6 and comprising one single core profile (37) which was also illustrated in FIG. 1 and which may, depending on the requirements, be supplemented by a limited number of insertion profiles (38).

Figure 5:
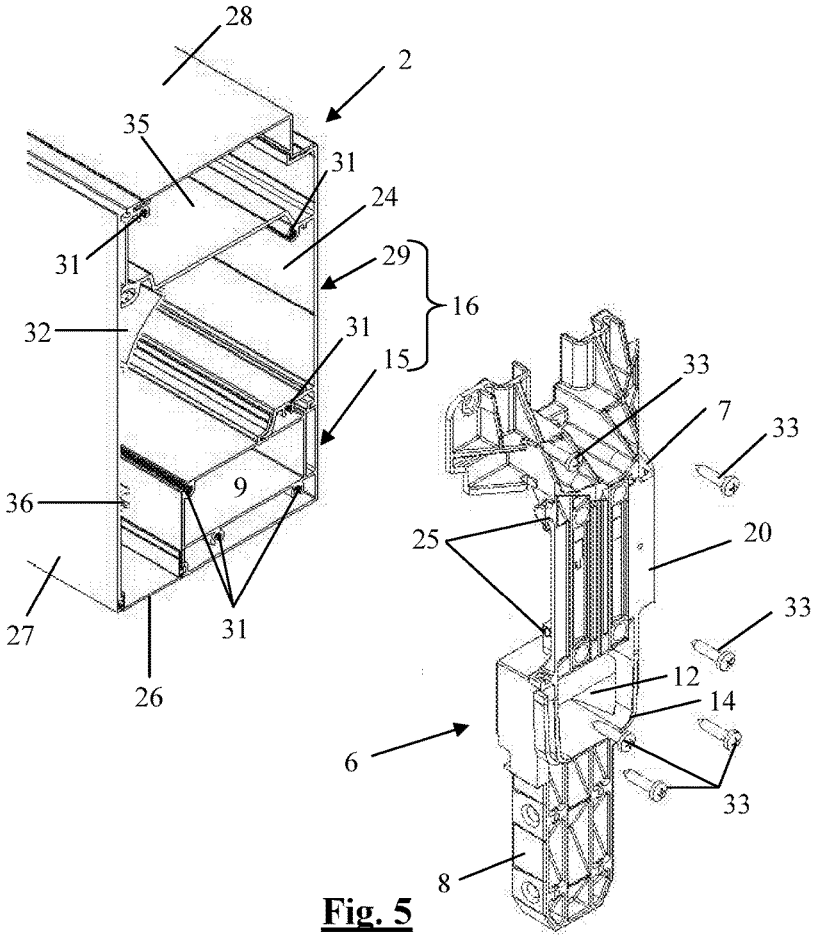
FIG. 5 shows a cut-away perspective view of the way in which a end cap with pin of a screen device according to the present invention can be attached to a beam of this screen device.

In order to attach the beams (2, 3, 4) to the columns (1), this screen device (1) comprises a first type of end cap (6) which is shown in more detail in FIGS. 1 and 5-6.

Figure 7:
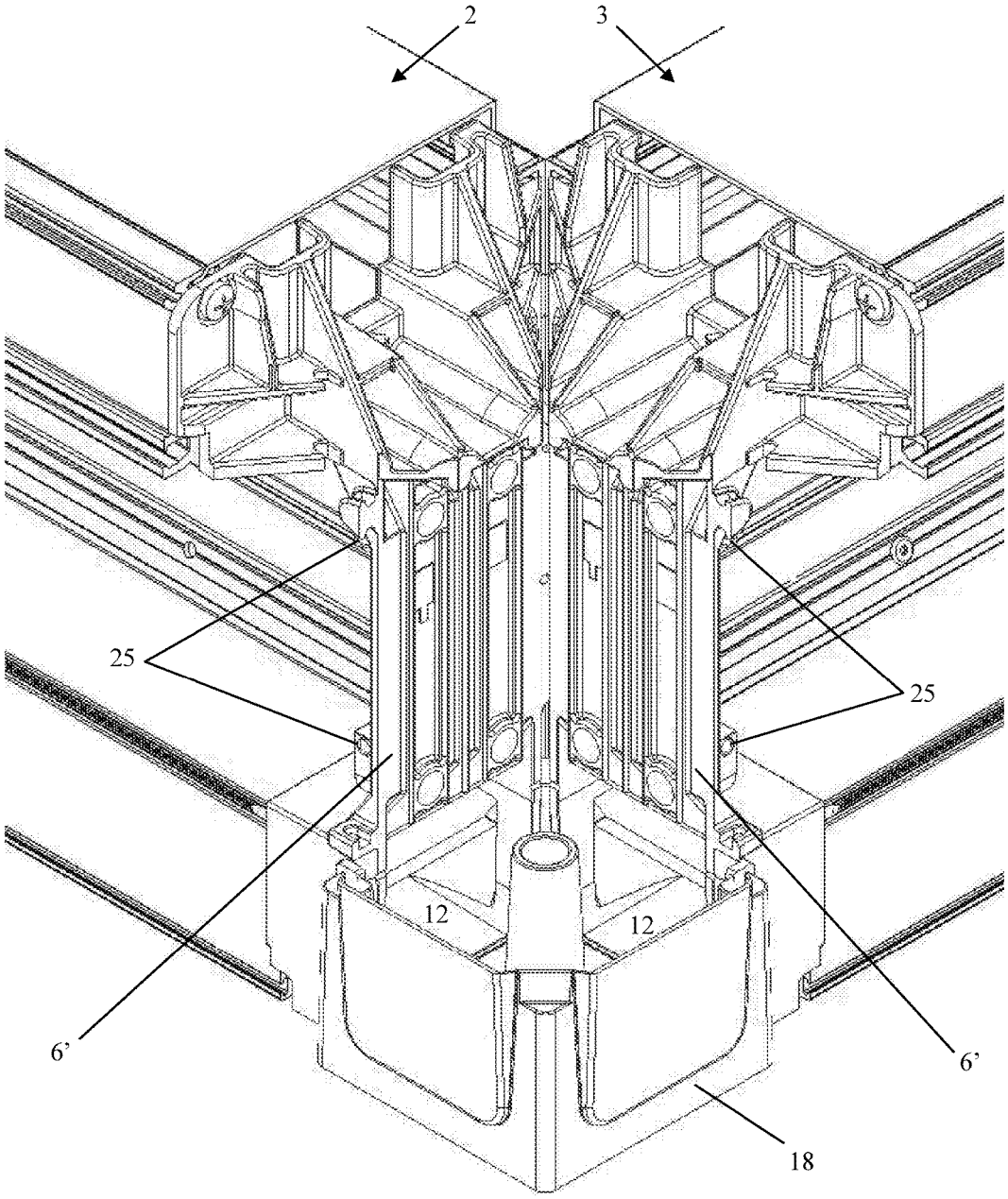
FIG. 7 shows a perspective view of the way in which two beams of a screen device according to the present invention are arranged at an angle with respect to each other, without a supporting column.

In order to connect the beams (2, 3, 4) to each other without a supporting column (1) at the location of their mutual connection, this screen device (1) comprises a second type of end cap (6') which is shown in more detail in FIG. 7.

In addition, the screen device (1) also comprises two types of collectors (17, 18) which correspond to the end caps (6, 6').

Furthermore, the screen device (1) comprises drainpipes (not shown), filler elements (not shown) for forming an optionally displaceable filling of the frames as covering, possible, optionally displaceable wall-shaped filler elements (not shown), a limited number of finishing profiles (not shown), reinforcing elements (23) and fastening means (33) (partly shown) and further optional parts (not shown), such as for example drive parts for displaceable filler elements, heating elements, lighting elements, etc.

Filler elements for filling the frames as covering may be fixedly arranged filler elements or displaceable filler elements. The displaceable filler elements are typically screens which can be rolled up onto and unrolled from a screen roller and/or tiltable and/or slidable slats, etc. In the closed position, the displaceable filler elements form a watertight roof from which water is typically drained off towards the pivot beams (2, 4) and from there via the clamping beams (3) and/or the columns (5). This roof may be at least partly opened and/or closed by sliding and/or rotating slats and/or by rolling up a screen, in order thus to either allow the sun and/or wind through or not, as desired.

Wall-shaped filler elements are typically intended to screen off openings underneath the covering, between columns (5). These may also be fixedly arranged filler elements or displaceable filler elements. Displaceable filler elements are typically screens which can be rolled up onto and unrolled from a screen roller or wall elements which are arranged with respect to each other so as to be displaceable, etc.

The beams (2, 3, 4) of the screen device (1) are hollow, as can clearly be seen in FIGS. 2-4. To this end, they are composed of a number of profiles (15, 26, 27, 28, 29) which are assembled to form a beam-shaped element.

Below, the various profiles (15, 26, 27, 28, 29) of these beams (2, 3, 4) and their mutual connection are examined further. It goes without saying that several variants thereof are conceivable, both with regard to the composition of the beams (2, 3, 4) and the mutual connection of the profiles (15, 26, 27, 28, 29).

Each illustrated beam (2, 3, 4) comprises a core profile (16) which provides the required strength and stiffness for the beam (2, 3, 4), and finishing profiles (27) and cover profiles (28) which complete the beams (2, 3, 4).

In the centre of the illustrated clamping beam (3) (see FIG. 3) and in the pivot beam (2) for an outer side of the screen device (1) (see FIG. 2), an internal cavity (24) is provided, in which a screen roller is arrangeable for rolling up and unrolling a screen thereon or therefrom, respectively, which can serve as a wall-forming element of the screen device (1).

In order to give access to this internal space (24), these beams (2, 3) comprise a cover profile (27) which is readily removable and is also readily fittable. This cover profile (27) is hooked onto the beam (3) at the top by means of a hook connection (41), in which a projecting rib of this cover profile (27) is hooked in a slot of the adjacent core profile (16), and can in this case be tilted with respect to this connection by sliding the rib in the corresponding slot.

At an intermediate distance from this hook connection (41), this cover profile (27) is click-fitted by means of a click-fit connection (42) to an elastically deformable fastening element which is fitted in a slot of the core profile (16).

The cover profile (27) is in each case provided with a reinforcing rib (32). As a result thereof, these beams (2, 3) may also be constructed to have the required resistance to relatively great loads, in particular for bridging relatively great distances.

Furthermore, the cover profile (27) is in each case provided with a mounting slot (36) for fitting reinforcing and/or fastening elements therein.

At the top of the core profile (16), the illustrated clamping beam (3) and the pivot beam (2) comprise a technical space (35), in which, for example, drive means for tilting slats as roof covering or cabling for, for example, lighting, etc. may be fitted. This technical space (35) is closed off by a cover profile (28) which, on its first side, is hooked into a slot of the core profile (16) by means of a hook connection (43) and, on its other side, can be fastened to the core profile (16) by means of fastening means.

In the pivot beam (4) which is to be centrally arranged in the screen device (4) (see FIG. 4), the cover profile (28) also offers access to a technical space (39) at the top which remains accessible at all times and may thus be used to accommodate, for example, lines. Here, the cover profile (28) is click-fitted into elastic elements by means of two click-fit connections (45) which have been fitted into corresponding slots of the core profile (16).

At the bottom, each beam (2, 3, 4) comprises a gutter profile (15). In the illustrated clamping beam (3) and in the pivot beam (2) for an outer side of the screen device (1), the gutter profile (15), on one side, is hooked (46) onto the overhead profile (29) and, on the other side, riveted (30) to the overhead profile (29) in order, together with this overhead profile (29), to form the core profile (16) of these beams (2, 3). In the illustrated pivot beam (4) which is to be centrally arranged in the screen device (4), the gutter profile (15), on one side, is hooked (46) onto the core profile (16) and, on the other side, fastened thereto by means of fastening means (47).

In the pivot beam (2) for an outer side of the screen device (1) (see FIG. 2), the gutter profile (15) comprises a lateral gutter (10) for collecting precipitation falling on the covering and an internal gutter (9) which extends next to the lateral gutter (10) and centrally in the beam (2). Between the lateral gutter (10) and the internal gutter (9), a partition (11) is arranged which is provided with perforations for draining off precipitation from the lateral gutter (10) towards the internal gutter (9).

In the clamping beam (3) (see FIG. 3), the gutter profile (15) only comprises an internal gutter (9) for passing through precipitation via this beam (3) from an adjoining pivot beam (2, 4) to a column (5), via which this precipitation can leave the screen device (1).

In the pivot beam (4) which is to be centrally arranged in the screen device (4) (see FIG. 4), the gutter profile (15) comprises two lateral gutters (10) for draining off adjacent coverings, and an internal gutter (9) which is arranged between both lateral gutters (10) and centrally at the bottom of the beam (4). Between the lateral gutters (10) and the internal gutter (9), a partition (11) is in each case arranged which is provided with perforations for draining off precipitation from the corresponding lateral gutter (10) towards the internal gutter (9).

The beams (2, 3, 4) are furthermore in each case provided with screw ducts (31) for screwing a end cap (6, 6') to these beams (2, 3, 4) at an end of these beams (2, 3, 4) using screws (33).

The columns (5) of this illustrated screen device (1) in each case comprise a hollow core profile (37) with a virtually cruciform cross section. This core profile (37) thus comprises four fitting slots (48) in its periphery (see FIG. 1), in which insertion profiles (38) are in each case arrangeable to form a corner of the column (5) (see FIG. 6), in such a way that after an insertion profile (38) has been fitted in each fitting slot (48), the column (5) has a virtually square cross section. By providing the insertion profiles (38) with other functions (for example screen guide, lighting fitting, etc.), the columns (5) may optionally be given different functions.

The profiles (15, 26, 27, 28, 29, 37, 38) of the beams (2, 3, 4) and the columns (5) may, for example, be made from aluminium by extrusion. It is also conceivable to make these profiles (15, 26, 27, 28, 29, 37, 38), for example, from steel or from stainless steel or from wood, etc. However, the use of these materials is less preferred.

The embodiment of the end caps (6) for fastening a beam (2, 3, 4) to the top of a column (5) comprises a downward pin (8) which, as can be seen in FIGS. 1 and 6, is arrangeable in the cavity of the column (5) in such a way that the pin (8) engages behind a side wall of the core profile (37) of the column (5).

The embodiment of the end caps (6') for fastening beams (2, 3, 4) to each other without being supported by a column (5) does not comprise such a downward pin (8) and is furthermore configured in such a way that the end cap (6'), viewed parallel to the cross sections of the beams (2, 3, 4), always remains within the dimensions of these cross sections, so that the connection of beams (2, 3, 4) can be finished without parts which project with respect to the beams (2, 3, 4) (see FIG. 8).

Both embodiments of end caps (6, 6') comprise a passage opening (12) for connecting to the internal gutter (9) of the beams (2, 3, 4) in order to allow precipitation which has been drained off via the internal gutter (9) to flow through it.

The screen device (1) furthermore comprises collectors (17, 18) which correspond to the end caps (6, 6') and which are designed to be fitted adjacent to the passage opening (12), as can be seen in FIGS. 6 and 7. These collectors (17, 18) can then be used to collect precipitation flowing from the internal gutter (9) through the passage opening (12).

The end caps (6, 6') in each case comprise a spout-shaped piece (14), adjoining the passage opening (12).

The collectors (17, 18) are configured as a collecting recess which comprise four insertion spaces (19) at their top edge, so that the spout-shaped piece (14) can be fitted therein in order to be able to fit this spout-shaped piece (14) on the top edge of the collector (17, 18).

The embodiment of the collector (18) which is designed for connecting two beams (2, 3, 4) to each other without being supported by a column (5) is designed so as to be able thus to transfer precipitation from the internal gutter (9) of the one beam (2, 3, 4) to the internal gutter (9) of the other beam (2, 3, 4), as can be seen in FIG. 7.

The embodiment of the collector (17) which is designed for connecting a beam (2, 3, 4) to a column (5), is provided with a connecting piece (22) for connecting said collector (17) to a drainpipe which can be fitted in the cavity of the core profile (37) of the column (5), as can be seen in FIG. 6. This embodiment of a collector (17) is furthermore provided with attachment feet (49) at the bottom, by means of which it can readily be placed at the top of a column (5).

In order to correctly position two beams (2, 3, 4) which are connected to each other at an angle and to reinforce the connection, the screen device (1) comprises a reinforcing coupling piece (23) having a substantially L-shaped cross section which can be screwed onto the corresponding end caps (6, 6'), as can be seen in FIG. 6. As a result of this coupling piece (23), the beams (2, 3, 4) are also accurately aligned with respect to each other, so that further finishing elements (not shown) for closing off the open spaces next to the beams (2, 3, 4) can also be fitted in such a way that they are accurately aligned with respect to each other and with respect to the beams (2, 3, 4) and column (5).

After the end caps (6, 6') have been fitted to the end of a beam (2, 3), at least one through-opening extends next to the end cap (6, 6'), as can be seen in FIGS. 6 and 7. This through-opening is designed in order to allow a screen which can be rolled up and unrolled to extend through it. This through-opening is thus useful in cases where a end cap (6, 6') is attached to a beam (2, 3) with an internal cavity (24) in which a screen roller is arranged with a screen which can be rolled up onto and unrolled from the latter, and in which the lateral sides of this screen are guided in screen guides which are incorporated in a column (5).

Figure 9:
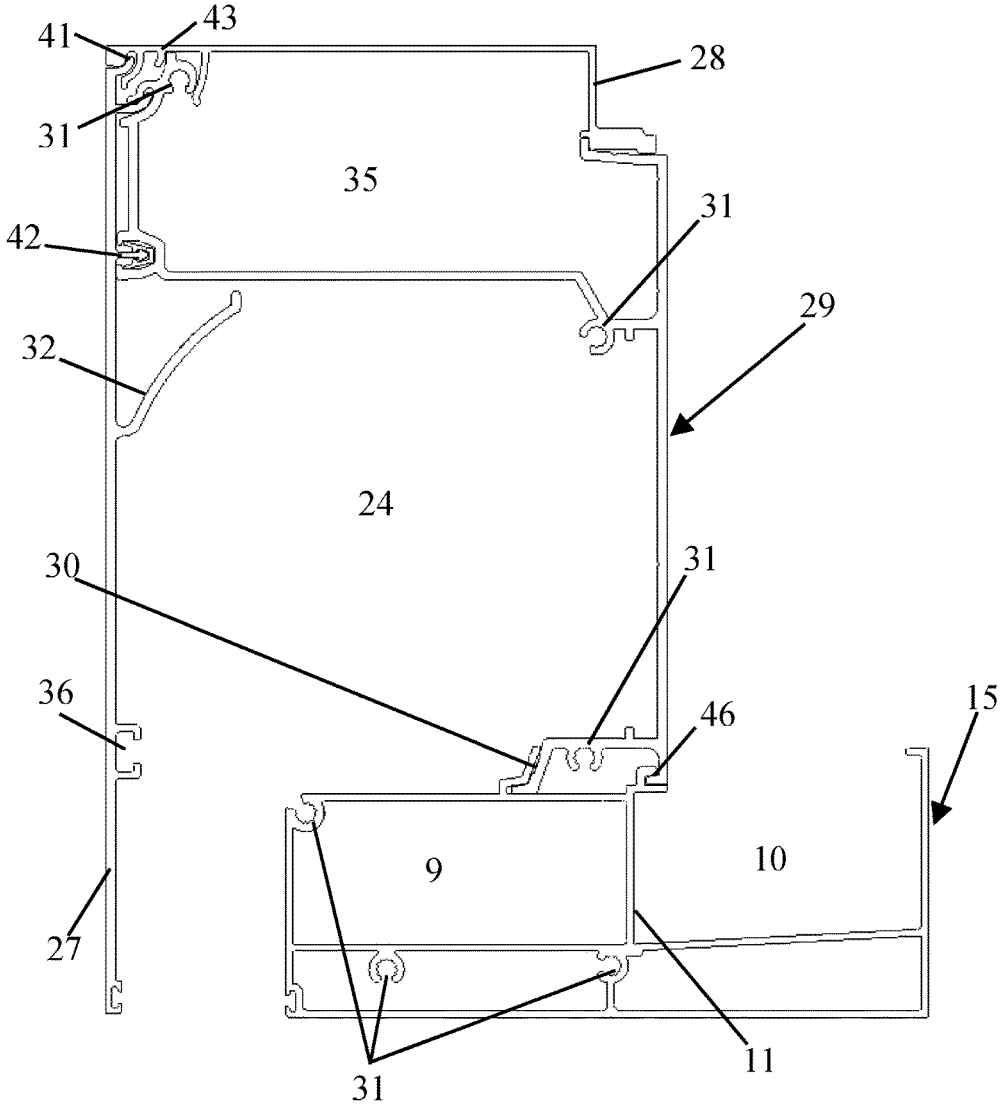
FIG. 9 shows a cross section of the first beam of a screen device according to the present invention, as shown in FIG. 2, with profile 26 removed.
Figure 10:
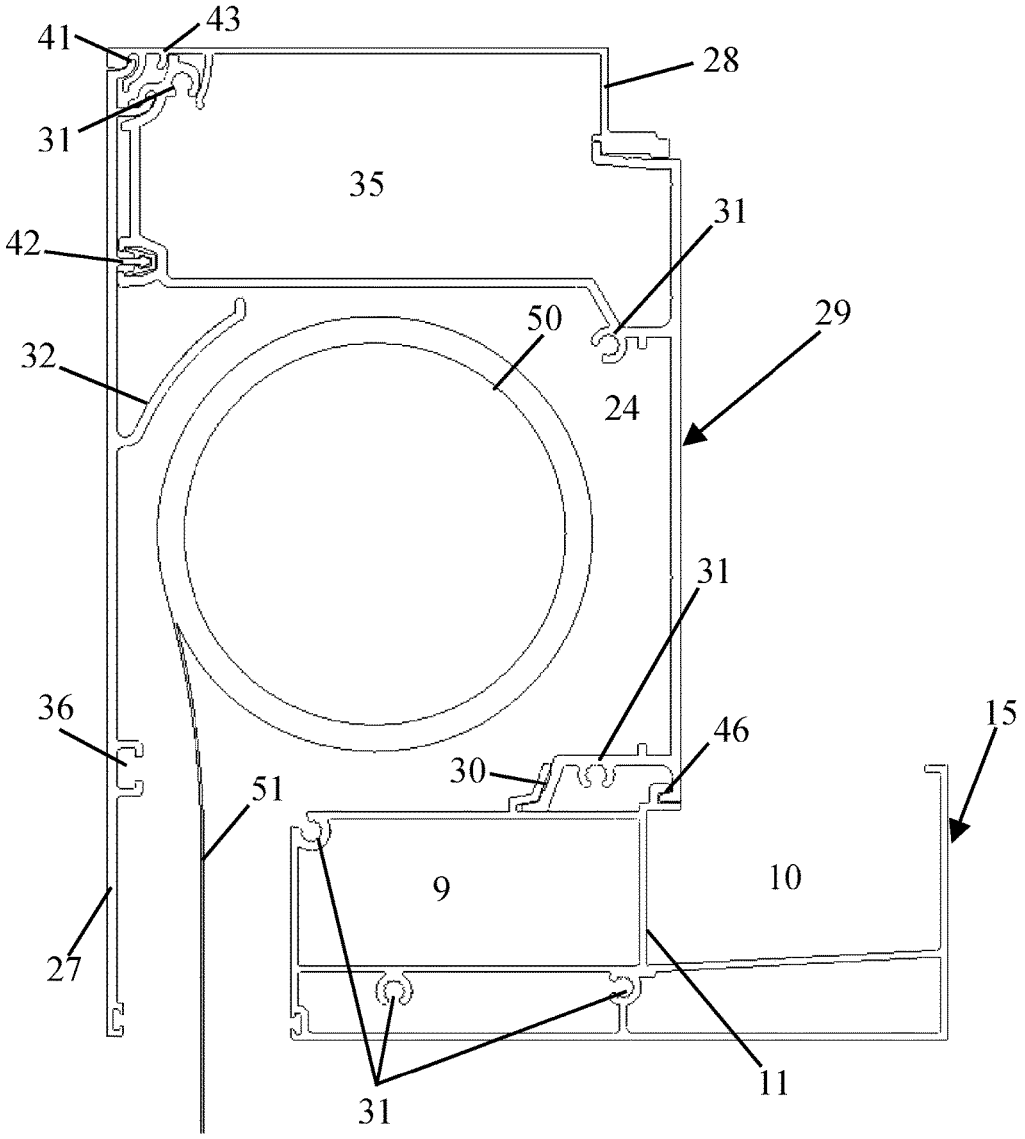
FIG. 10 shows a cross section of the first beam of a screen device according to the present invention, as shown in FIG. 9, with a screen roller arranged in the internal cavity and a screen attached to the screen roller.

In order to be able to fit the screen roller (50) in the internal cavity of such a beam (2, 3), with the lateral sides of said screen being guided in screen guides which are incorporated in a column (5), and with the screen (51) extending out of the bottom of the beam (2, 3) in the area where profile (26) may otherwise be fitted (as shown in FIGS. 9 and 10), the end caps (6, 6') comprise a central part (20) which extends at a certain distance from the beam (2, 3) after the end cap (6, 6') has been fitted to the end of the beam (2, 3), as can be seen in FIGS. 1, 6 and 7, and to which the screen roller is coupleable in order to accommodate the screen roller in the internal cavity (24). To this end, this central part (20) comprises coupling elements (25) facing the beam (2, 3), which are indicated in FIGS. 5, 6 and 7, for coupling coupling elements of the screen roller thereto for accommodating the screen roller in the internal cavity (24).

The invention claimed is:

1. Screen device, comprising:

a covering which comprises a beam as a structural part of the covering and which is attachable to at least one adjacent structural part of the screen device;

wherein said screen device comprises an end cap which is attachable to an end of the beam in order to attach the beam to the adjacent structural part of the screen device;

wherein the beam is hollow and comprises an internal gutter in its cavity for draining off precipitation falling onto the covering, and the end cap is provided with a passage opening for connecting to the internal gutter so as to enable precipitation drained off via the internal gutter to flow into a cavity of the adjacent structural part;

wherein the beam is provided with a lateral gutter for collecting precipitation falling onto the covering, the lateral gutter extending at least partly next to the internal gutter;

wherein a partition extends between the lateral gutter and the internal gutter where the lateral gutter and the internal gutter are next to each other, and the partition is provided with perforations for draining off precipitation from the lateral gutter towards the internal gutter.

2. Screen device according to claim 1, characterized in that the lateral gutter and the internal gutter form part of the same gutter profile.

3. Screen device according to claim 1, characterized in that the end cap comprises a spout-shaped piece adjoining the passage opening, and the screen device comprises a collector which is arrangeable between the beam and the adjacent structural part in order to allow precipitation to flow into the collector via the spout-shaped piece and through the passage opening towards the cavity of the adjacent structural part.

4. Screen device according to claim 3, characterized in that the collector is configured as a collecting recess which comprises at least one insertion space at its top edge, in which the spout- shaped piece is arrangeable on the top edge of the collecting recess.

5. Screen device, comprising:

a covering which comprises a beam as a structural part of the covering, the beam comprising an internal cavity;

a screen roller arranged in the internal cavity;

a screen which can be rolled up onto and unrolled from the screen roller;

screen guides for guiding the lateral sides of the screen;

a column for supporting the beam for supporting the covering; and an end cap which is attachable to an end of the beam in order to attach the beam to the column;

wherein the end cap comprises a central part which extends at a certain distance from the beam after the end cap has been fitted to the end of the beam and to which the screen roller is coupleable to accommodate the screen roller in the internal cavity;

wherein after the end cap has been fitted to the end of the beam, at least one through-opening extends next to the end cap, through the end of the beam, the distance and the through-opening being such that the screen partly extends through this through-opening.

6. Screen device according to claim 5, characterized in that the central part comprises coupling elements in the direction towards the beam for coupling coupling elements of the screen roller thereto in order to accommodate the screen roller in the internal cavity.

7. Screen device according to claim 1, characterized in that said screen device comprises a column as an adjacent structural part for supporting the beam for supporting the covering, and the end cap comprises a base body for attaching the end cap to the end of the beam and an attachment member which extends with respect to the base body and which is arrangeable at the top of the column in such a way that the beam extends substantially above and next to the column in order to couple the beam to the column to support the beam.

8. Screen device according to claim 7, characterized in that the attachment member of the end cap is configured as a pin which extends downwards with respect to the base body and is arrangeable in the top of the column.

9. Screen device according to claim 8, characterized in that the column is hollow and the pin of the end cap can be fitted in the cavity of the column in such a way that the pin engages behind a side wall of the column.

10. Screen device according to claim 3, characterized in that said screen device comprises a column as an adjacent structural part for supporting the beam for supporting the covering, and the end cap comprises a base body for attaching the end cap to the end of the beam and an attachment member which extends with respect to the base body and which is arrangeable at the top of the column in such a way that the beam extends substantially above and next to the column in order to couple the beam to the column to support the beam, wherein the attachment member of the end cap is configured as a pin which extends downwards with respect to the base body and is arrangeable in the top of the column, wherein the collector is arrangeable on top of the column in order to allow precipitation to flow into the collector via the spout- shaped piece and through the passage opening to the column.

11. Screen device according to claim 10, characterized in that the screen device comprises a drainpipe which is arrangeable in the cavity of the column in order to drain off precipitation via the column, and the collector comprises a connecting piece in order to connect said collector to the drainpipe.

12. Screen device according to claim 1, characterized in that the beam comprises a core profile, to which one or more cover profiles are attachable.

13. Screen device according to claim 12, characterized in that the beam comprises several profiles which have been riveted together to form the core profile of the beam.

14. Screen device according to claim 13, characterized in that the lateral gutter and the internal gutter form part of the same gutter profile and the gutter profile forms part of the core profile.

15. Screen device according to claim 8, characterized in that the collector is arrangeable on top of the column in order to allow precipitation to flow into the collector via the spout-shaped piece and through the passage opening to the column.

16. Screen device according to claim 5, wherein the beam is hollow and comprises an internal gutter in its cavity for draining off precipitation falling onto the covering, and wherein the end cap is provided with a passage opening for connecting to the internal gutter so as to enable precipitation drained off via the internal gutter to flow into a cavity of the column.

17. Screen device according to claim 16, wherein the beam is provided with a lateral gutter for collecting precipitation falling onto the covering, the lateral gutter extending at least partly next to the internal gutter, wherein a partition extends between the lateral gutter and the internal gutter where the lateral gutter and the internal gutter are next to each other, and the partition is provided with perforations for draining off precipitation from the lateral gutter towards the internal gutter.

18. Screen device according to claim 17, wherein the lateral gutter and the internal gutter form part of the same gutter profile.

19. Screen device according to claim 16, wherein the end cap comprises a spout-shaped piece adjoining the passage opening, and wherein the screen device comprises a collector which is arrangeable between the beam and the column in order to allow precipitation to flow into the collector via the spout-shaped piece and through the passage opening towards the cavity of the column.

20. Screen device according to claim 19, wherein the collector is configured as a collecting recess which comprises at least one insertion space at its top edge, wherein the spout-shaped piece is arrangeable on the top edge of the collecting recess.

* * * * *